US011118432B2

(12) United States Patent
Frosell et al.

(10) Patent No.: US 11,118,432 B2
(45) Date of Patent: Sep. 14, 2021

(54) WELL APPARATUS WITH REMOTELY ACTIVATED FLOW CONTROL DEVICE

(71) Applicant: Halliburton Energy Services, Inc., Houston, TX (US)

(72) Inventors: Thomas Jules Frosell, Irving, TX (US); Stephen Michael Greci, Little Elm, TX (US); Gary John Geoffroy, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 332 days.

(21) Appl. No.: 15/776,383

(22) PCT Filed: Jun. 19, 2017

(86) PCT No.: PCT/US2017/038177
§ 371 (c)(1),
(2) Date: May 15, 2018

(87) PCT Pub. No.: WO2018/236339
PCT Pub. Date: Dec. 27, 2018

(65) Prior Publication Data

US 2020/0263520 A1 Aug. 20, 2020

(51) Int. Cl.

| | |
|---|---|
| ***E21B 43/08*** | (2006.01) |
| ***E21B 34/16*** | (2006.01) |
| ***E21B 43/04*** | (2006.01) |
| ***E21B 47/13*** | (2012.01) |

(Continued)

(52) U.S. Cl.
CPC ..... *E21B 43/08* (2013.01); *E21B 34/16* (2013.01); *E21B 43/045* (2013.01); *E21B 33/12* (2013.01); *E21B 47/13* (2020.05); *E21B 47/14* (2013.01); *E21B 2200/04* (2020.05); *E21B 2200/05* (2020.05); *E21B 2200/06* (2020.05)

(58) Field of Classification Search
CPC ..... E21B 43/08; E21B 34/16; E21B 43/045; E21B 2200/06; E21B 33/12; E21B 2200/04; E21B 2200/05; E21B 47/14; E21B 47/13
See application file for complete search history.

(56) References Cited

U.S. PATENT DOCUMENTS 5,332,038 A * 7/1994 Tapp ..... E21B 23/06 166/278
6,241,015 B1 6/2001 Pringle et al.
(Continued)

OTHER PUBLICATIONS

International Search Report and the Written Opinion for International Application No. PCT/US2017/038177 dated Feb. 28, 2018, 14 pages.

*Primary Examiner* — Taras P Bemko
*Assistant Examiner* — Jonathan Malikasim
(74) *Attorney, Agent, or Firm* — Chamberlain Hrdlicka

(57) ABSTRACT

An apparatus for controlling fluid flow into a well includes an outer tubular member and an inner tubular member. The outer tubular member includes a screen configured to enable fluid flow therethrough between an exterior and an interior of the outer tubular member. The inner tubular member is configured to be positionable within the outer tubular member. The inner tubular member is a remotely activated flow control device configured to control fluid flow between an exterior and an interior of the inner tubular member.

17 Claims, 7 Drawing Sheets

(51) Int. Cl.
*E21B 33/12* (2006.01)
*E21B 47/14* (2006.01)

(56) References Cited

U.S. PATENT DOCUMENTS

| | | | | |
|---|---|---|---|---|
| 7,128,152 | B2 * | 10/2006 | Anyan | E21B 43/045 166/278 |
| 7,331,388 | B2 * | 2/2008 | Vilela | E21B 37/08 166/278 |
| 8,770,290 | B2 * | 7/2014 | van Petegem | E21B 43/08 166/278 |
| 2002/0020535 | A1 * | 2/2002 | Johnson | E21B 49/08 166/363 |
| 2002/0096328 | A1 | 7/2002 | Echols et al. | |
| 2006/0076133 | A1 | 4/2006 | Penno | |
| 2015/0047837 | A1 | 2/2015 | Turner et al. | |
| 2015/0192001 | A1 | 7/2015 | Hall | |
| 2016/0281461 | A1 | 9/2016 | Reid et al. | |

* cited by examiner

WELL APPARATUS WITH REMOTELY ACTIVATED FLOW CONTROL DEVICE

BACKGROUND

This section is intended to provide relevant contextual information to facilitate a better understanding of the various aspects of the described embodiments. Accordingly, it should be understood that these statements are to be read in this light and not as admissions of prior art.

The present disclosure generally relates to oil and gas exploration and production, and more particularly to a completion system for use in gravel packing operations.

Wells are drilled at various depths to access and produce oil, gas, minerals, and other naturally-occurring deposits from subterranean geological formations. Hydrocarbons may be produced through a wellbore traversing the subterranean formations. Gravel packing operations are commonly performed in subterranean formations to control production of unconsolidated particulates with the hydrocarbons. A typical gravel packing operation involves placing a filtration bed containing gravel particulates near the wellbore that neighbors the zone of interest. The filtration bed acts as a type of physical barrier to the transport of unconsolidated particulates to the wellbore that could be produced with the produced fluids. One common type of gravel packing operation involves placing a sand control screen in the wellbore and packing the annulus between the screen and the wellbore with gravel particulates of a specific size designed to prevent the passage of formation sand. The sand control screen is generally a filter assembly used to retain the gravel placed during the gravel pack operation. In addition to the use of sand control screens, gravel packing operations may involve the use of a wide variety of sand control equipment, including liners (e.g., slotted liners, perforated liners, etc.), combinations of liners and screens, and other suitable apparatus. A wide range of sizes and screen configurations are available to suit the characteristics of the gravel particulates used. Similarly, a wide range of sizes of gravel particulates are available to suit the characteristics of the unconsolidated particulates. The resulting structure presents a barrier to migrating sand from the formation while still permitting fluid flow.

BRIEF DESCRIPTION OF THE DRAWINGS

Illustrative embodiments of the present disclosure are described in detail below with reference to the attached drawing figures, which are incorporated by reference herein and wherein.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

Oil and gas hydrocarbons are naturally occurring in some subterranean formations. A subterranean formation containing oil or gas may be referred to as a reservoir, in which a reservoir may be located under land or off shore. Reservoirs are typically located in the range of a few hundred feet (shallow reservoirs) to a few tens of thousands of feet (ultra-deep reservoirs). To produce oil or gas, a wellbore is drilled into a reservoir or adjacent to a reservoir.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

Figure 1A:
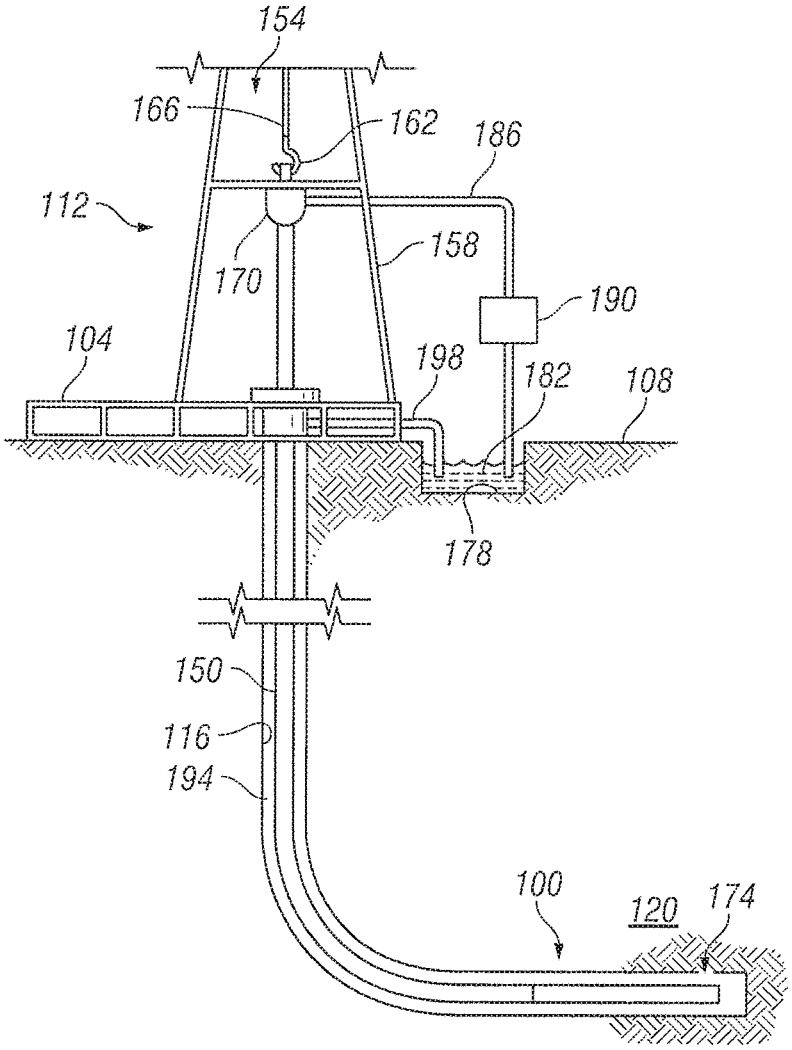
FIG. 1A shows a schematic view of an on-shore well having a completion system in accordance with one or more embodiments of the present disclosure.
Figure 1B:
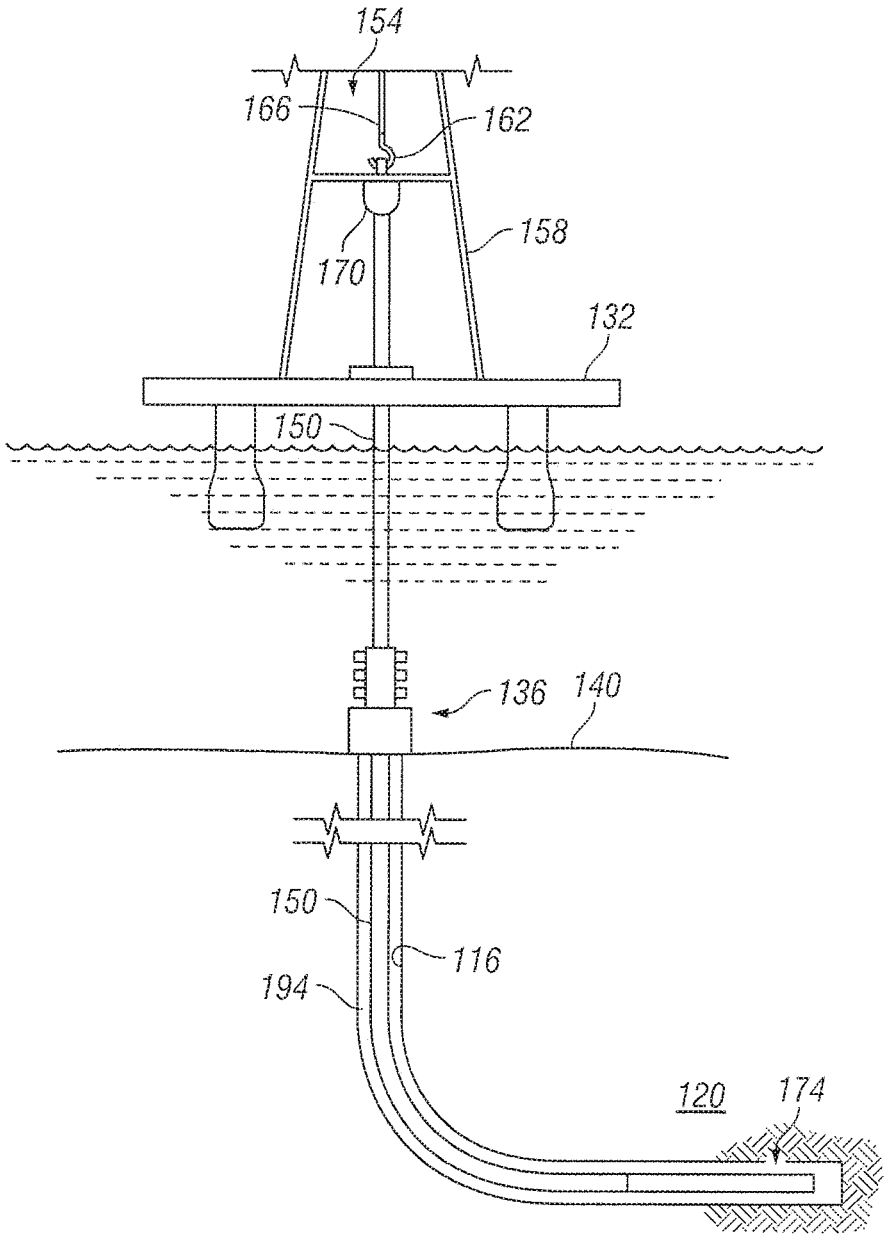
FIG. 1B shows a schematic view of an off-shore well having a completion system in accordance with one or more embodiments of the present disclosure.

FIG. 1A illustrates a schematic view of a rig 104 operating a completion system 100 according to one or more embodiments of the present disclosure. The rig 104 is positioned at a surface 108 of a well 112. The well 112 includes a wellbore 116 that extends from the surface 108 of the well 112 into a subterranean substrate or formation 120. The well 112 and the rig 104 are illustrated onshore in FIG. 1A. Alternatively, FIG. 1B illustrates a schematic view of an off-shore platform 132 operating the completion system 100 according to one or more embodiments of the present disclosure. The completion system 100 may be deployed in a subsea well 136 accessed by the offshore platform 132. The offshore platform 132 may be a floating platform or may instead be anchored to a seabed 140.

FIGS. 1A and 1B each illustrate possible uses or deployments of the completion system 100, and while the following description of the system 100 primarily focusses on the use of the completion system 100 during the completion and production stages, the system 100 also may be used in other stages of the well where it may be desired to set packers, or create or maintain multiples zones within the wellbore. In the embodiments illustrated in FIGS. 1A and 1B, the wellbore 116 has been formed by drilling into the subterranean formation 120.

After drilling of the wellbore 116 is complete and the associated drill bit and drill string are "tripped" from the wellbore 116, a work string 150, which may also eventually function as a production string, is lowered into the wellbore 116. The work string 150 may include sections of tubing, each of which are joined to adjacent tubing by threaded or other connection types. The work string 150 may refer to the collection of pipes or tubes as a single component, or alternatively to the individual pipes or tubes that comprise the string. The term work string (or tubing string or production string) is not meant to be limiting in nature and may refer to any component or components that are capable of being coupled to the completion system 100 to lower or raise the completion system 100 in the wellbore 116 or to provide energy to the completion system 100 such as that provided by fluids, electrical power or signals, or mechanical motion. Mechanical motion may involve rotationally or axially manipulating portions of the work string 150. In some embodiments, the work string 150 may include a passage disposed longitudinally in the work string 150 that is capable of allowing fluid communication between the surface 108 of the well 112 and a downhole location 174.

The lowering of the work string 150 may be accomplished by a lift assembly 154 associated with a derrick 158 positioned on or adjacent to the rig 104 or offshore platform 132. The lift assembly 154 may include a hook 162, a cable 166, a traveling block (not shown), and a hoist (not shown) that cooperatively work together to lift or lower a swivel 170 that is coupled an upper end of the work string 150. The work string 150 may be raised or lowered as needed to add additional sections of tubing to the work string 150 to position the completion system 100 at the downhole location 174 in the wellbore 116.

A reservoir 178 may be positioned at the surface 108 to hold a fluid 182 for delivery to the well 112 during setting of the completion system 100. A supply line 186 is fluidly coupled between the reservoir 178 and the passage of the work string 150. A pump 190 drives the fluid 182 through the supply line 186 and the work string 150 toward the downhole location 174. The fluid 182 may also be used to carry out debris from the wellbore 116 prior to or during the completion process. Still other uses of the fluid 182 may entail delivery of gravel or a proppant in a slurry to the downhole location 174 so that the well 112 may be gravel packed. After traveling downhole, the fluid 182 or portions thereof returns to the surface 108 by way of an annulus 194 between the work string 150 and the wellbore 116 or another provided flow path. At the surface 108, the fluid may be returned to the reservoir 178 through a return line 198. The fluid 178 may be filtered or otherwise processed prior to recirculation through the well 112.

Figure 2:
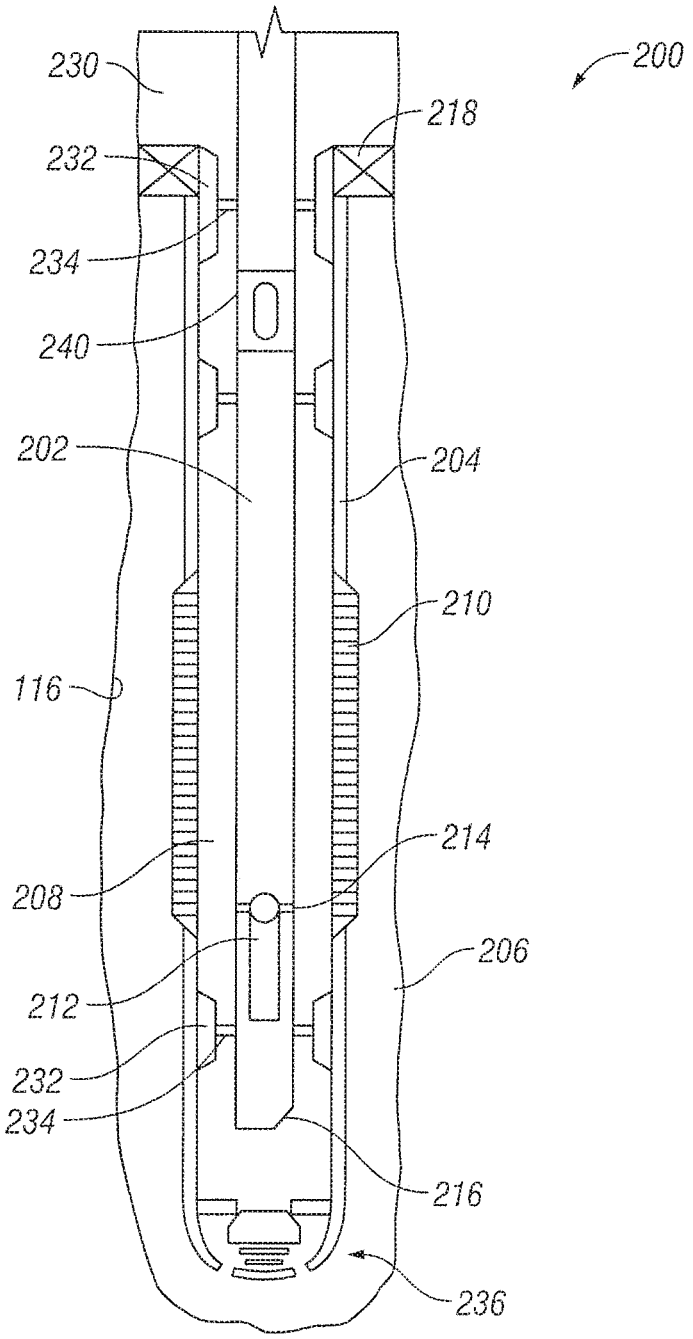
FIG. 2 shows a schematic view of an apparatus to control fluid flow in a well in accordance with one or more embodiments of the present disclosure.

Referring now to FIG. 2, a schematic view of an apparatus 200 used for controlling fluid flow into a well in accordance with one or more embodiments of the present disclosure is shown. The apparatus 200 is shown positioned within a wellbore 116 and includes an inner tubular member 202 positioned within an outer tubular member 204. The inner tubular member 202 and the outer tubular member 204 may be individual tubular members, or may be formed as or part of a string of tubular members. The inner tubular member 202, for example, may be part of a work string, and the outer tubular member 204 may be part of an outer string, such as of a gravel pack assembly.

The apparatus 200 is positioned in the wellbore 116 to form an annulus 206 between an exterior of the outer tubular member 204 and the wellbore 116. The inner tubular member 202 is positioned within the outer tubular member 204 to form an annulus 208 between an exterior of the inner tubular member 202 and an interior of the outer tubular member 204. The outer tubular member 204 includes a screen 210 to enable fluid flow through the screen 210 between the exterior and the interior of the outer tubular member 204 (e.g., between the annulus 206 and the annulus 208). Further, the inner tubular member 202 includes a remotely activated flow control device 212 that selectively controls fluid flow between the exterior and the interior of the inner tubular member 202. In particular, the inner tubular member 202 may include one or more ports 214 formed through a wall of the inner tubular member 202, in which the remotely activated flow control device 212 may be remotely opened and closed to enable and prevent fluid flow between the exterior and the interior of the inner tubular member 202 through the port 214.

The remotely activated flow control device 212 may be remotely activated, such as upon receipt of a signal, to control fluid flow between the exterior and the interior of the inner tubular member 202. For example, in one or more embodiments, the remotely activated flow control device 212 may be a computer-controlled, electromechanical device that may be repeatedly opened and closed by a remote signal or command. The remotely activated flow control device 212 may be a valve, such as a ball valve, a flapper valve, and/or a sliding sleeve. Accordingly, in one embodiment, the remotely activated flow control device 212 may be the same as or similar to the electromechanical ball valve unit commercially available as the electronic remote equalizing device (eRED), known as the ERED® valve, manufactured by Red Spider Technology through Halliburton Energy Services, Inc. of Houston, Tex., USA. Also, the remotely activated flow control device 212 may be the same or similar to the valve described and discussed in U.S. Pub. No. 2016/0281461.

The remotely activated flow control device 212 may be or include an interventionless valve. The remotely activated flow control device 212 may be activated or controlled upon receipt of one or more different types of signals, commands, or triggers. Exemplary signals may be based on or include, but are not limited to, one or more temperatures, pressures, flow rates, times, electromagnetisms, changes thereof, or any combination thereof. In one or more embodiments, the signal is based on at least one of the temperature of the fluid, the pressure of the fluid, the flow rate of the fluid, or any combination thereof.

Figure 3:
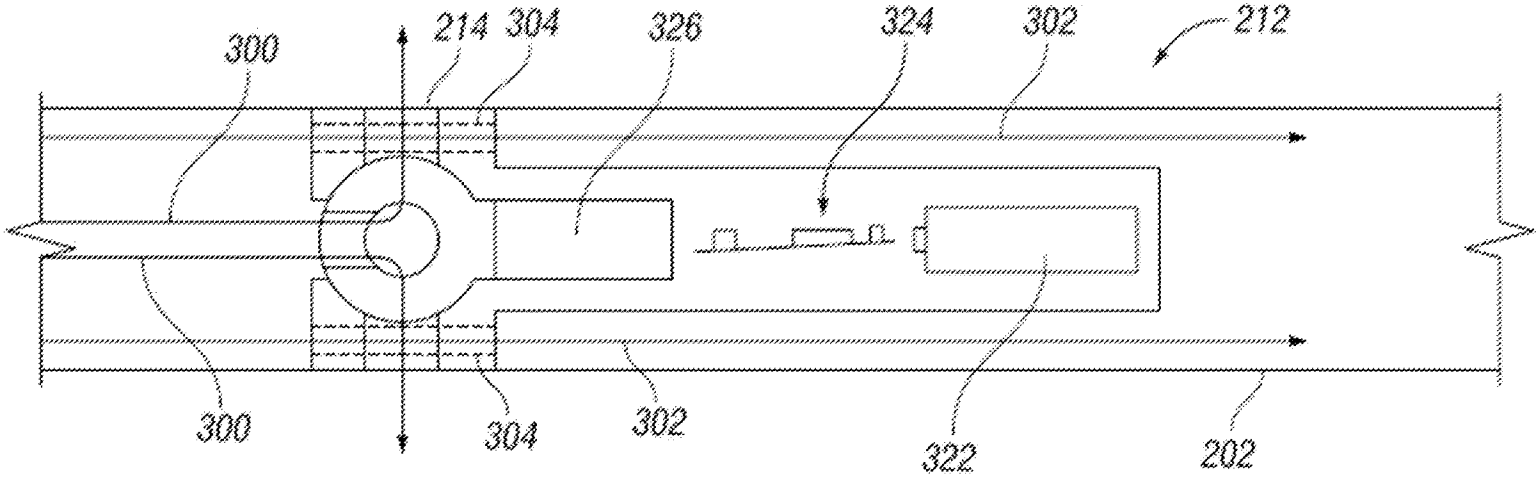
FIG. 3 shows a schematic view of a remotely activated flow control device in accordance with one or more embodiments of the present disclosure.

FIG. 3 provides a schematic view of the remotely activated flow control device 212 in accordance with one or more embodiments of the present disclosure. As shown, the remotely activated flow control device 212 includes a sensing system 322, a signal processor 324, and/or an actuation device 326 arranged within a body. The sensing system 322 senses one or more properties or characteristics, such as of the fluid flowing through the device 212, to control the remotely activated flow control device 212. For example, in an embodiment in which the device 212 is controlled with a pressure based signal, the device 212 includes an inlet port to receive the pressure to the sensing system 322. The inlet port of the remotely activated flow control device 212 feeds a pressure channel that extends axially through the remotely activated flow control device 212 and fluidly communicates with the sensing system. The sensing system 322 includes one or more pressure sensors or transducers configured to detect, measure, and/or report fluid pressures within the remotely activated flow control device 212 as sensed through the pressure channel.

The sensing system 322 is communicably coupled to the signal processor 324, which is configured to receive pressure signals generated by the sensing system 322. While not shown, the signal processor 324 includes various computer hardware used to operate the remotely activated flow control device 212 including, but not limited to, a processor configured to execute one or more sequences of instructions, programming stances, or code stored on a non-transitory, computer-readable medium. The processor can be, for example, a general-purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. Computer hardware can further include elements such as, for example, a memory (e.g., random access memory (RAM), flash memory, read only memory (ROM), programmable read only memory (PROM), or erasable programmable read only memory (EPROM)), registers, hard disks, removable disks, CD-ROMS, or any other like suitable storage device or medium.

The actuation device 326 is communicably coupled to the signal processor 324 and configured to actuate the remotely activated flow control device 212 upon receiving a command signal generated by the signal processor 324. The actuation device 326 is operatively coupled to the remotely activated flow control device 212, such as via a drive shaft, a gearing mechanism, or the like. The actuation device 326 may be any electrical, mechanical, electromechanical, hydraulic, or pneumatic actuation device, or any combination thereof, that is able to rotate the remotely activated flow control device 212 about the central axis and thereby move the remotely activated flow control device 212 between the open and closed positions. In operation, for example, when a given command signal is received from the signal processor 324, the actuation device 326 is configured to rotate the remotely activated flow control device 212 about the central axis from the closed position to the open position.

In a pressure-based signal embodiment, the remotely activated flow control device 212 is programmed to be responsive to pressure pulses sensed by the sensing system 322 via the pressure channel. The sensing system 322 is configured to detect the pressure pulses and report the same to the signal processor 324, which compares the received pressure signals with one or more signature pressure pulses stored in memory. Once a signature pressure pulse is detected by the sensing system 322, the signal processor 324 is configured to generate and send a command signal to the actuation device 326 to actuate the remotely activated flow control device 212 between open and closed positions. The signature pressure pulse that may trigger the remotely activated flow control device 212 may include one or more cycles of pressure pulses at a predetermined amplitude (e.g., strength or pressure) and/or over a predetermined amount of time (e.g., frequency). In other embodiments, the signature pressure pulse may be a series of pressure increases over a predetermined or defined time period followed by a reduction of the pressure for another predetermined or defined period. Several different types or configurations of potential signature pressure pulses may be used to trigger actuation of the remotely activated flow control device 212. Further, in addition or in alternative to a pressure based signal, the remotely activated flow control device 212 in accordance with the present disclosure may also be controlled or active with a temperature based signal, a flow rate based signal, a time based signal, an electromagnetism based signal, or any combination thereof.

As mentioned above, the flow control device 212 is movable between an open position and a closed position within the inner tubular member 202. In the open position, the flow control device 212 may enable fluid flow through the port 214 between the exterior and the interior of the inner tubular member 202. In the closed position, the flow control device 212 may prevent fluid flow 300 through the port 214 between the exterior and the interior of the inner tubular member 202. Further, the remotely activated flow control device 212 may enable fluid flow 302 through the interior of the inner tubular member 202 and across the device 212 when in the open position and the closed position through bypass flow paths 304. With reference to FIG. 2, the inner tubular member 202 may include an opening 216 located downhole or further downstream from the remotely activated flow control device 212, such as having the opening 216 formed at an end of the inner tubular member 202. As the remotely activated flow control device 212 enables fluid flow through the interior of the inner tubular member 202 and across the device 212 in the open position and the closed position, fluid flow through the inner tubular member 202 and out the opening 216, independent of the position of the device 212.

The inner tubular member 202 and the outer tubular member 204 are connected to each other initially, such as when deploying the flow control apparatus 200 into the wellbore 116. The inner tubular member 202 and the outer tubular member 204 of the apparatus 200 are run into the wellbore 116 together, and once in a desired position, a packer 218 coupled to the outer tubular member 204 is set to seal against the wall of the wellbore 116. The packer 218 may be any type of packer known in the art, such as a settable packer, an inflatable packer, and/or a swellable packer. If the packer 218 is a settable packer, the packer may be mechanically, pneumatically, hydraulically, and/or electrically set.

Once the packer 218 is set within the wellbore 116, the packer 218 seals against the wall of the wellbore 116 and secures the position of the outer tubular member 204 within the wellbore 116. The packer 218 seals against the wellbore 116 defines the annulus 206 between the exterior of the outer tubular member 204 and the wellbore 116 below the packer 218. As the packer 218 is positioned at an upper end of the outer tubular member 204, the packer 218 seals against the wellbore 116 also defines an annulus 230 between the exterior of the inner tubular member 202 and the wellbore 116 above the packer 218. Further, once deployed, the inner tubular member 202 may be unlatched or disconnected from the outer tubular member 204 such that the inner tubular member 202 is movable with respect to the outer tubular member 204.

Referring still to FIG. 2, the outer tubular member 204, as shown, includes one or more seal bores 232 and the inner tubular member 202 includes one or more seal assemblies 234. The seal bores 232 are included within the interior of the outer tubular member 204, and are formed as reduced diameter portions (e.g., compared to other portions of the flow path of the outer tubular member) positioned or formed within the interior flow path of the outer tubular member 204. The seal assemblies 234 are positioned on the exterior of the inner tubular member 202 to engage and seal against the seal bores 232. The positioning and engagement of the seal assemblies 234 with the seal bores 232 may be used to control the fluid flow within the annulus 208 between the interior of the outer tubular member 204 and the exterior of the inner tubular member 202.

As shown in FIG. 2, the outer tubular member 204 may include a valve 236, such as a one-way valve (e.g., a float shoe), located downhole or further downstream from the remotely activated flow control device 212 of the inner tubular member 202. The valve 236 is shown as positioned at an end of the outer tubular member 204 in FIG. 2. The valve 236 enables one-way fluid flow between the annuluses 206 and 208, enabling fluid to flow from the interior to the exterior of the outer tubular member 204 through the valve 236, but preventing fluid from flowing in the other direction from the exterior to the interior of the outer tubular member 204 through the valve 236.

Lastly, the inner tubular member 202 may include a crossover assembly 240 in one or more embodiments. The crossover assembly 240 may be included within the interior of the inner tubular member 202 to enable fluid flow to be directed down one path when flowing in one direction through the crossover assembly 240 and directed down another path when flowing in the other direction through the crossover assembly 240.

Figure 4:
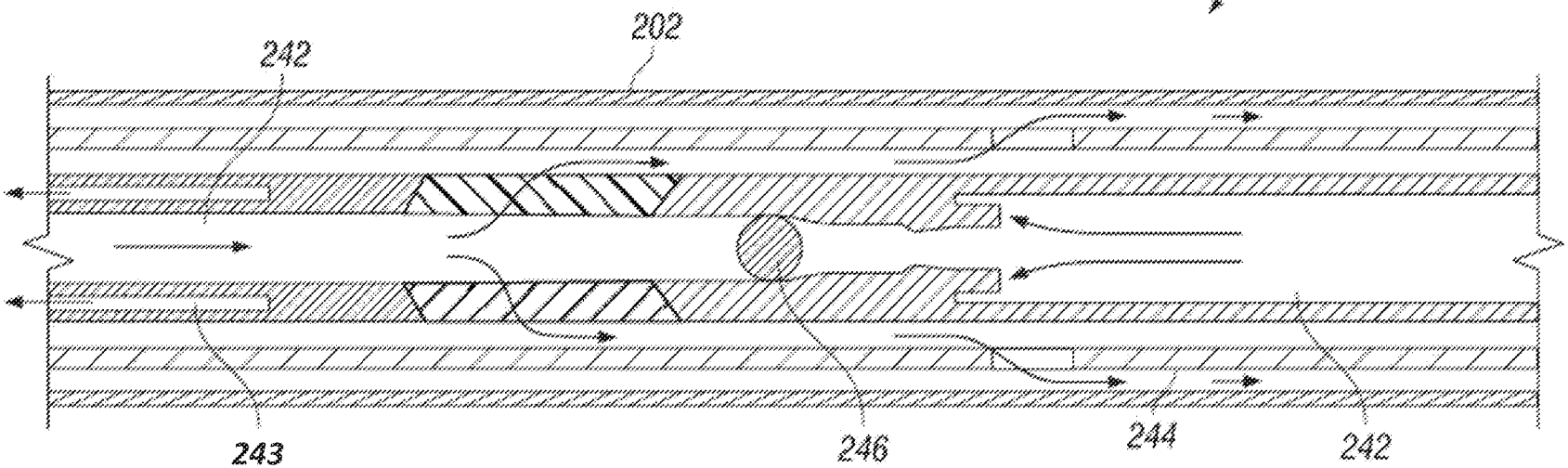
FIG. 4 shows a cross-sectional view of a crossover assembly in accordance with one or more embodiments of the present disclosure.

FIG. 4 shows a cross-sectional view of a crossover assembly 240 included within the inner tubular member 202 in accordance with one or more embodiments of the present disclosure. The inner tubular member 202 in this embodiment has multiple flow paths formed therethrough, such as an inner flow path 242 and an annulus flow path 244. Further, though not limited to this embodiment, the crossover assembly 240 as shown is a ball drop activated crossover assembly with a ball 246 that is deployed and landed within the crossover assembly 240. Fluid flowing downhole or downstream through the inner tubular member 202 is directed from the inner flow path 242 to the annulus flow path 244 by the ball 246 at the crossover assembly 240. Further, fluid flowing uphole or upstream through the inner tubular member 202 is also directed from the inner flow path 242 to a secondary flow path 243 around the ball 246 at the crossover assembly 240. The crossover assembly 240 directs and arranges fluid flow through the inner tubular member 202 while enabling the fluid flow downstream to be maintained separately from the fluid flow back upstream.

Referring now back to FIG. 2, the apparatus 200 may be used to control and direct fluid flow within the wellbore 116 and into and out of the inner tubular member 202 and the outer tubular member 204. For example, as the apparatus 200 may be included or used with a gravel pack assembly, the apparatus 200 may be used to create a fluid flow path within the wellbore 116 at the location of the gravel pack assembly. Fluid may be pumped down the inner tubular member 202 and through the interior of the inner tubular member 202. The remotely activated flow control device 212 may initially be in a closed position, thereby preventing fluid flow out through the port 214. Accordingly, fluid pumped down through the interior of the inner tubular member 202 will exit the inner tubular member 202 through the opening 216. As a seal assembly 234 is in sealing engagement with the seal bore 232 and the outer tubular member 204 includes the valve 236 (e.g., the float shoe), fluid exiting the inner tubular member 202 through the opening 216 will also exit the interior of the outer tubular member 204 through the valve 236 and flow into the annulus 206. The fluid may then flow into and through a gravel pack assembly in the annulus 206, if present, such as for purposes of cleaning or facilitating fluid flow.

Once fluid is in the annulus 206, the packer 218 prevents the fluid in the annulus 206 from flowing further uphole in the exterior of the outer tubular member 204. Rather, the fluid can flow through the screen 210, being filtered through the screen 210, and into the annulus 208 between the interior of the outer tubular member 204 and the exterior of the inner tubular member 202. The annulus 208 is further defined in this embodiment by the seal assemblies 234 of the inner tubular member 202 sealingly engaging the seal bores 232 of the outer tubular member 204.

A signal may then be sent to the remotely activated flow control device 212 to move the device 212 from the closed position to the open position, thereby enabling fluid to flow out of the annulus 208 and back into the interior of the inner tubular member 202. The signal, for example, may be sent through the fluid flow through the interior of the inner tubular 202, such as through a time-dependent or predetermined pattern of pressures, flow rates, temperatures. Once the flow control device 212 is opened, fluid may flow through the port 214 and back into the interior of the inner tubular member 202.

Fluid flowing into the interior of the inner tubular member 202 through the port 214 may flow through the crossover assembly 240 and back uphole, such as to the surface. For example, fluid flowing downhole through the crossover assembly 240 (e.g., top-to-bottom in FIG. 2) may flow down the interior of the inner tubular member 202 and exit out through the opening 216. Fluid then flowing back uphole through the crossover assembly 240 (e.g., bottom-to-top in FIG. 2), such as fluid entering the inner tubular member 202 through the port 214, may be maintained in a separate flow path. The crossover assembly 240 may direct the uphole fluid flow through a separate fluid flow path through the inner tubular member 202, such as in an annulus flow path formed within the inner tubular member. Alternatively, the crossover assembly 240 may enable fluid to flow back uphole through the annulus 230 formed between the inner tubular member 202 and the wellbore 216.

As discussed above, the inner tubular member 202 and the outer tubular member 204 of the apparatus 200 may be initially connected or latched to each other, such as before or when being deployed into the wellbore 116. Once in the desired or predetermined position, the packer 218 of the outer tubular member 204 may be set to secure the outer tubular member 204 and apparatus 200 altogether within the wellbore 116. Once set, fluid may be pumped into the inner tubular member 202, through the apparatus 200, and into and out of the annulus 206. After a desired amount of fluid has been pumped through the apparatus 200, the inner tubular member 202 and the outer tubular member 204 of the apparatus 200 may be disconnected or detached from each other such that the inner tubular member 202 is movable with respect to the outer tubular member 204. This may enable the inner tubular member 202 to be retrieved, such as back to the surface, while the outer tubular member 204 remains in the wellbore 116 for further service.

The apparatus 200 incorporates the use of the remotely activated flow control device 212 to prevent unnecessary movement between the inner tubular member 202 and the outer tubular member 204. For example, previously without the use of a remotely activated flow control device 212, the inner tubular member 202 must be moved with respect to the outer tubular member 204 to control the fluid flow through the apparatus 200 by selectively engaging and sealing the seal assemblies 234 with the seal bores 232. To enable fluid to flow from the interior of the inner tubular member 202 to the exterior of the outer tubular member 204 and into the annulus 206, the inner tubular member 202 must be oriented or positioned with respect to the outer tubular member 204 as shown in FIG. 2 such that fluid would flow out from the apparatus 200 through the valve 236 at the bottom of the outer tubular member 204. To enable fluid then to flow through the screen 210 and back into the interior of the inner tubular member 202, the inner tubular member 202 must be raised or lowered with respect to the outer tubular member 204 such that the seal assemblies 234 no longer engage and seal against the seal bores 232. This arrangement would enable fluid to flow back into the opening 216 at the bottom of the inner tubular member 202.

The remotely activated flow control device 212 and the port 214, on the other hand, may reduce the need to move the inner tubular member 202 and the outer tubular member 204 with respect to each other to allow circulation of fluids during different pumping operations, such as placement of the gravel pack in the wellbore 116 at the annulus 206 between the wellbore 116 and the screen 210 of the gravel pack assembly. Rather, a signal need only be sent to the remotely activate flow control device 212 to selectively open and close, thereby enabling fluid flow out of the annulus 206, through the screen 210, and back up through the inner tubular member 202. This prevents having to selectively move the inner tubular member 202 and the outer tubular member 204 with respect to each other for the seal assemblies 234 and seal bores 232 to engage and disengage, which may prove difficult when the apparatus 200 is hundreds or thousands of feet deep within the wellbore 116.

Figure 5A:
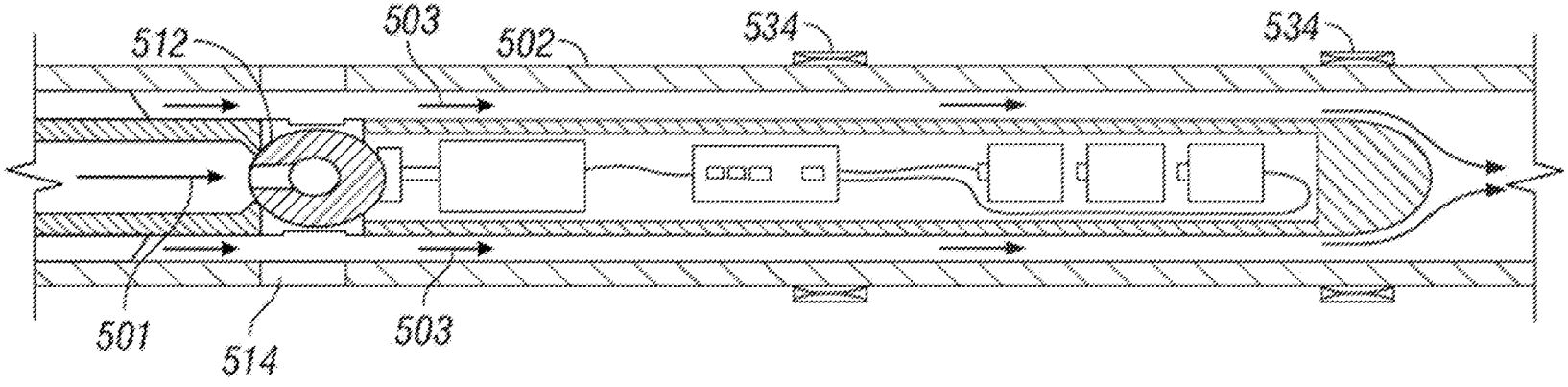
FIGS. 5A and 5B show cross-sectional views of an inner tubular member in accordance with one or more embodiments of the present disclosure.
Figure 5B:
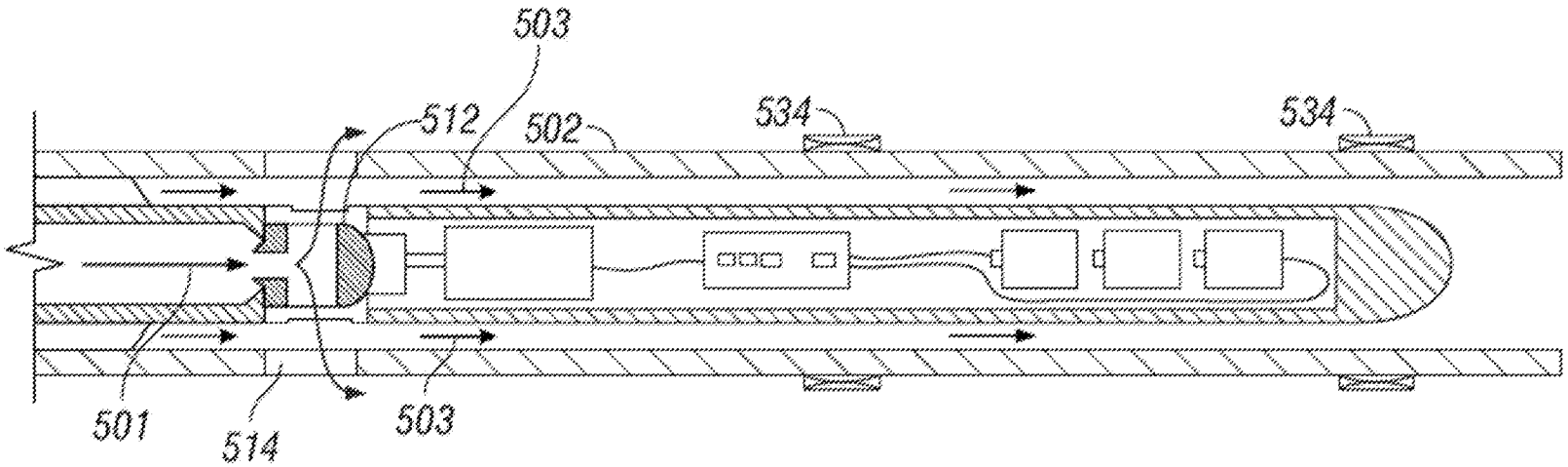
Figure 6A:
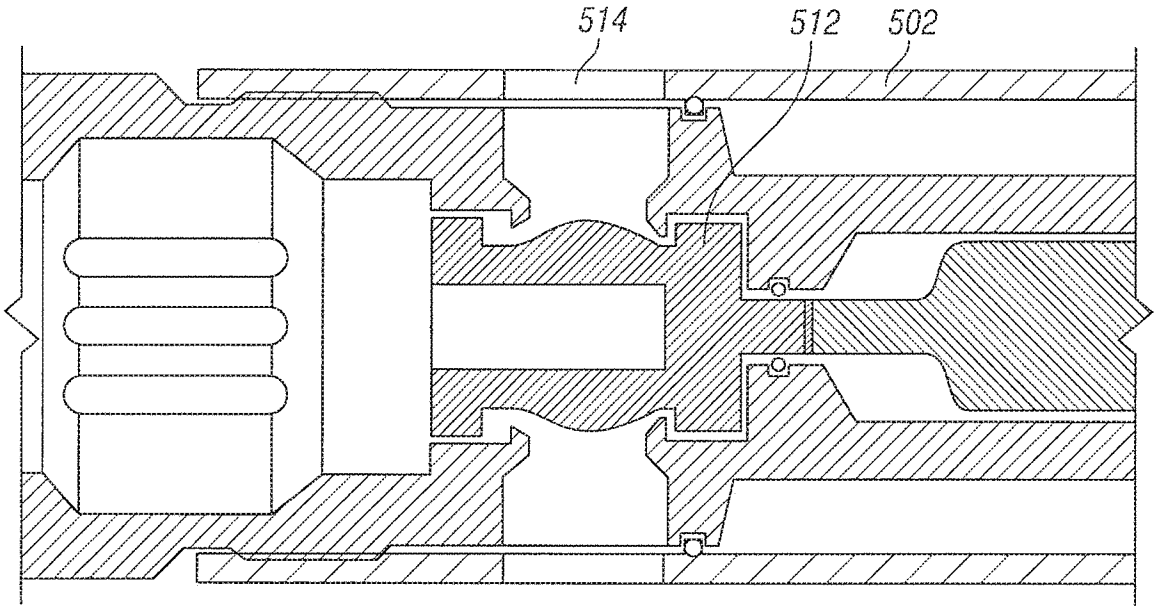
FIGS. 6A and 6B show cross-sectional views of a remotely activated flow control device in accordance with one or more embodiments of the present disclosure.
Figure 6B:
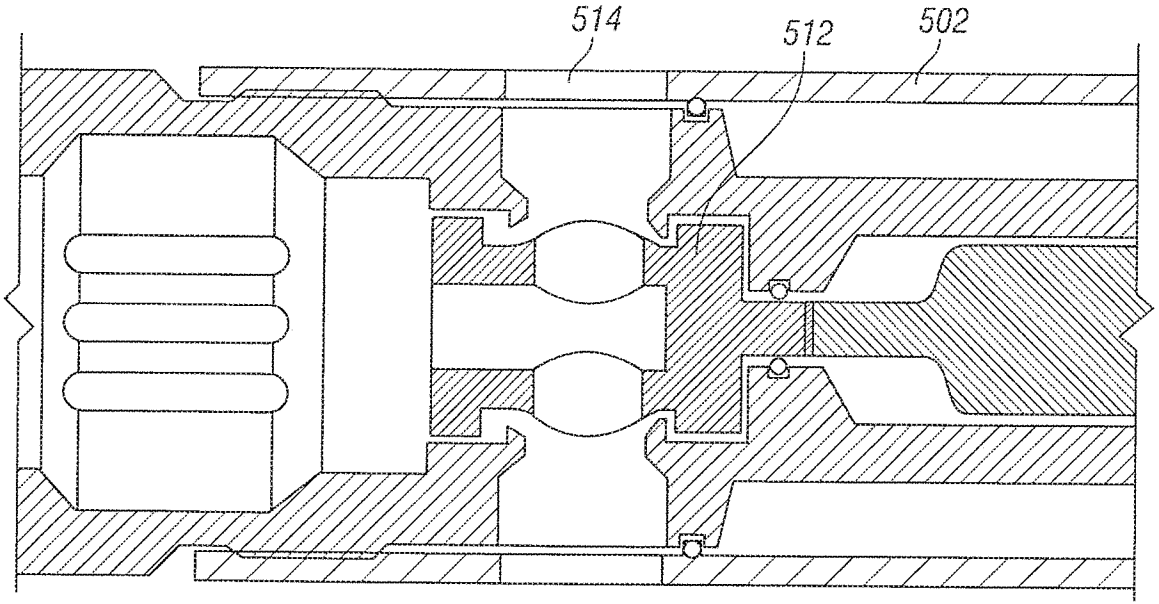

Referring now to FIGS. 5A, 5B, 6A, and 6B, multiple cross-sectional views of an inner tubular member 502 and a remotely activated flow control device 512 in accordance with one or more embodiments of the present disclosure are shown. FIGS. 5A and 6A show the remotely activated flow control device 512 in a closed position, preventing fluid flow through the port 514 and between the interior and exterior of the inner tubular member 502. Fluid flow is also enabled past the flow control device 512 via a bypass flow path 503, remaining within the interior of the inner tubular member 502, and past the seal assemblies 534 positioned on the exterior of the inner tubular member 502, such as to flow out through an opening located further downhole. FIGS. 5B and 6B show the remotely activated flow control device 512 in an open position, enabling fluid flow 501 through the port 514 and between the interior and exterior of the inner tubular member 502. The fluid may also flow through the port 514 and the flow control device 512, into the interior of the inner tubular member 502 and further uphole.

In addition to the embodiments described above, many examples of specific combinations are within the scope of the disclosure, some of which are detailed below:

Embodiment 1

An apparatus for controlling fluid flow into a well, comprising:

an outer tubular member comprising a screen configured to enable fluid flow therethrough between an exterior and an interior of the outer tubular member; and an inner tubular member configured to be positionable within the outer tubular member, the inner tubular member comprising a remotely activated flow control device configured to control fluid flow between an exterior and an interior of the inner tubular member.

Embodiment 2

The apparatus of Embodiment 1, wherein the inner tubular member is movable with respect to the outer tubular member.

Embodiment 3

The apparatus of Embodiment 2, wherein:

the outer tubular member comprises a flow path formed therethrough and a seal bore with a reduced diameter compared to a flow path diameter; and the inner tubular member comprises a seal assembly configured to engage and seal against the seal bore.

Embodiment 4

The apparatus of Embodiment 1, wherein the inner tubular member comprises an inner flow path, an annulus flow path, and a crossover assembly configured to enable fluid flow from the inner flow path to the exterior of the inner tubular member.

Embodiment 5

The apparatus of Embodiment 1, wherein the outer tubular member comprises a packer configured to set the outer tubular member within the well.

Embodiment 6

The apparatus of Embodiment 1, wherein the inner tubular member comprises an opening locatable further downhole in the well than the remotely activated flow control device.

Embodiment 7

The apparatus of Embodiment 6, wherein:

the outer tubular member comprises a valve locatable further downhole in the well than the opening of the inner tubular member; and the valve is configured to control fluid flow from the interior to the exterior of the outer tubular member.

Embodiment 8

The apparatus of Embodiment 7, wherein the one-way valve comprises a one-way valve.

Embodiment 9

The apparatus of Embodiment 1, wherein the remotely activated flow control device is movable between an open position to enable fluid flow between the exterior and the interior of the inner tubular member and a closed position to prevent fluid flow between the exterior and the interior of the inner tubular member.

Embodiment 10

The apparatus of Embodiment 9, wherein the remotely activated flow control device enables fluid flow through the interior of the inner tubular member in the open position and in the closed position.

Embodiment 11

The apparatus of Embodiment 1, wherein:
the inner tubular member comprises a work string; and
the outer tubular member comprises a gravel pack assembly comprising an outer string.

Embodiment 12

The apparatus of Embodiment 1, wherein:
the remotely activated flow control device comprises a ball valve, a flapper valve, or a sliding sleeve, and
the remotely activated flow control device is configured to be controlled by a temperature-based signal, a pressure based signal, a flow rate based signal, a time-based signal, or an electromagnetism based signal.

Embodiment 13

A method for controlling fluid flow into a well, comprising:
positioning an apparatus in the well, the apparatus comprising an inner tubular member at least partially positioned within an outer tubular member;
pumping fluid through the inner tubular member and out an opening of the inner tubular member; and
remotely activating a remotely activated flow control device in the inner tubular member to move from a closed position to an open position to allow fluid to flow through a screen of the outer tubular member and into the inner tubular member.

Embodiment 14

The method of Embodiment 13, further comprising:
deploying the inner tubular member and the outer tubular member connected to each other into the well;
disconnecting the inner tubular member from the outer tubular member such that the inner tubular member is movable with respect to the outer tubular member; and
retrieving the inner tubular member from the well with the outer tubular member remaining in the well.

Embodiment 15

The method of Embodiment 14, wherein the deploying comprises expanding a packer connected to the outer tubular member into engagement with a wall of the well.

Embodiment 16

The method of Embodiment 13, wherein:
remotely activating further comprises sending a signal into the well for the remotely activated flow control device to receive; and
the signal comprises a temperature based signal, a pressure based signal, a flow rate based signal, a time based signal, or an electromagnetism based signal.

Embodiment 17

The method of Embodiment 16, wherein the signal comprises a temperature-based signal, a pressure based signal, a flow rate based signal, a time-based signal, or an electromagnetism based signal.

Embodiment 18

An apparatus for controlling fluid flow into a well, comprising:
an outer tubular member comprising:
a screen configured to enable fluid flow therethrough between an exterior and an interior of the outer tubular member;
a packer configured to set the outer tubular member within the well;
a seal bore; and
a valve configured to control fluid flow from the interior to the exterior of the outer tubular member; and
an inner tubular member positionable within the outer tubular member, the inner tubular member comprising:
a remotely activated flow control device configured to control fluid flow between an exterior and an interior of the inner tubular member; and
a seal assembly configured to engage and seal against the seal bore.

Embodiment 19

The apparatus of Embodiment 1, wherein the inner tubular member and the outer tubular member are configured to disconnect from each other such that the inner tubular member is able to move with respect to the outer tubular member.

Embodiment 20

The apparatus of Embodiment 18, wherein:
the inner tubular member comprises a work string; and
the outer tubular member comprises a gravel pack assembly comprising an outer string.

One or more specific embodiments of the present disclosure have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

In the following discussion and in the claims, the articles "a," "an," and "the" are intended to mean that there are one or more of the elements. The terms "including," "comprising," and "having" and variations thereof are used in an open-ended fashion, and thus should be interpreted to mean "including, but not limited to . . . ." Also, any use of any form of the terms "connect," "engage," "couple," "attach," "mate," "mount," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. The use of "top," "bottom," "above," "below," "upper," "lower," "up," "down," "vertical," "horizontal," and variations of these terms is made for convenience, but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. An apparatus for controlling fluid flow into a well, comprising:

an outer tubular member comprising a screen configured to enable fluid flow therethrough between an exterior and an interior of the outer tubular member; and an inner tubular member positioned within the outer tubular member, the inner tubular member comprising:

a remotely activated flow control device configured to be controlled by a signal to control fluid flow between an exterior and an interior of the inner tubular member via a port in a sidewall of the inner tubular member; and a bypass flow path formed in the inner tubular member that allows a fluid to flow past the remotely activated flow control device and into the outer tubular member at a location downhole of the remotely activated flow control device, wherein the flow through the bypass flowpath is independent of the position of the remotely activated flow control device.

2. The apparatus of claim 1, wherein the inner tubular member is movable with respect to the outer tubular member.

3. The apparatus of claim 2, wherein:

the outer tubular member comprises a flow path formed therethrough and a seal bore with a reduced diameter compared to a flow path diameter; and the inner tubular member comprises a seal assembly configured to engage and seal against the seal bore.

4. The apparatus of claim 1, wherein the inner tubular member comprises a crossover assembly configured to enable fluid flow from an inner flow path within the inner tubular member to a secondary flow path.

5. The apparatus of claim 1, wherein the outer tubular member comprises a packer configured to set the outer tubular member within the well.

6. The apparatus of claim 1, wherein the inner tubular member comprises an opening locatable further downhole in the well than the remotely activated flow control device.

7. The apparatus of claim 6, wherein:

the outer tubular member comprises a valve locatable further downhole in the well than the opening of the inner tubular member; and the valve is configured to control fluid flow from the interior to the exterior of the outer tubular member.

8. The apparatus of claim 7, wherein the valve comprises a one-way valve.

9. The apparatus of claim 1, wherein the remotely activated flow control device is movable between an open position to enable fluid flow between the exterior and the interior of the inner tubular member and a closed position to prevent fluid flow between the exterior and the interior of the inner tubular member.

10. The apparatus of claim 9, wherein the remotely activated flow control device enables fluid flow through the interior of the inner tubular member in the open position and in the closed position.

11. The apparatus of claim 1, wherein the inner tubular member comprises a work string.

12. A method for controlling fluid flow into a well, comprising:

positioning an apparatus in the well, the apparatus comprising an inner tubular member at least partially positioned within an outer tubular member;

pumping a fluid through the inner tubular member via a bypass flowpath and into the outer tubular member at a location downhole of a remotely activated flow control device while the remotely activated flow control device is in a closed position, the remotely activated flow control device configured to control fluid flow between an exterior and an interior of the inner tubular member via a port in a sidewall of the inner tubular member; and remotely activating the remotely activated flow control device in the inner tubular member via a signal sent into the well from a surface to move from the closed position to an open position to allow the fluid to flow through a screen of the outer tubular member and into the inner tubular member via the port in the sidewall of the inner tubular member.

13. The method of claim 12, further comprising:

deploying the inner tubular member and the outer tubular member connected to each other into the well;

disconnecting the inner tubular member from the outer tubular member such that the inner tubular member is movable with respect to the outer tubular member; and retrieving the inner tubular member from the well with the outer tubular member remaining in the well.

14. The method of claim 13, wherein the deploying comprises expanding a packer connected to the outer tubular member into engagement with a wall of the well.

15. An apparatus for controlling fluid flow into a well, comprising:

an outer tubular member comprising:

a screen configured to enable fluid flow therethrough between an exterior and an interior of the outer tubular member;

a packer configured to set the outer tubular member within the well; a seal bore; and a valve configured to control fluid flow from the interior to the exterior of the outer tubular member; and an inner tubular member positioned within the outer tubular member, the inner tubular member comprising:

a remotely activated flow control device configured to be controlled by a signal to control fluid flow between an exterior and an interior of the inner tubular member via a port in a sidewall of the inner tubular member;

a bypass flow path formed in the inner tubular member that allows a fluid to flow past the remotely activated flow control device and into the outer tubular member at a location downhole of the remotely activated flow control device, wherein the flow through the bypass flowpath is independent of the position of the remotely activated flow control device; and a seal assembly configured to engage and seal against the seal bore.

16. The apparatus of claim 15, wherein the inner tubular member and the outer tubular member are configured to disconnect from each other such that the inner tubular member is able to move with respect to the outer tubular member.

17. The apparatus of claim 15, wherein the inner tubular member comprises a work string.

* * * * *